US007578906B2

(12) United States Patent
Shands et al.

(10) Patent No.: US 7,578,906 B2
(45) Date of Patent: Aug. 25, 2009

(54) HEADBOX AND STOCK DELIVERY SYSTEM FOR A PAPERMAKING MACHINE

(75) Inventors: Jay A. Shands, Belchertown, MA (US); James A. Ronning, Granby, CT (US); George C. Mendrala, Pittsfield, MA (US); Vaughn J. Wildfong, East Longmeadow, MA (US); Douglas R. McPherson, East Granby, CT (US)

(73) Assignee: AstenJohnson, Inc., Charleston, SC (US)

( * ) Notice: Subject to any disclaimer, the term of this patent is extended or adjusted under 35 U.S.C. 154(b) by 343 days.

(21) Appl. No.: 11/670,188

(22) Filed: Feb. 1, 2007

(65) Prior Publication Data

US 2007/0267164 A1 Nov. 22, 2007

Related U.S. Application Data

(60) Provisional application No. 60/764,053, filed on Feb. 1, 2006.

(51) Int. Cl.
*D21F 1/06* (2006.01)

(52) U.S. Cl. ..... 162/343; 162/344; 162/202

(58) Field of Classification Search ..... 162/343, 162/344, 202

See application file for complete search history.

(56) References Cited

U.S. PATENT DOCUMENTS

| | | | | |
|---|---|---|---|---|
| 3,296,066 | A | 1/1967 | Green et al. | |
| 3,734,822 | A | 5/1973 | Bennett et al. | |
| 4,137,124 | A | 1/1979 | Bubik et al. | |
| 4,146,052 | A | 3/1979 | Bubik et al. | |
| 4,262,700 | A | 4/1981 | Moen | |
| 4,783,241 | A | 11/1988 | Egelhof et al. | |
| 4,897,158 | A | 1/1990 | Weisshuhn et al. | |
| 4,909,904 | A | 3/1990 | Kinzler | |
| 5,183,537 | A | 2/1993 | Hergert et al. | |
| 5,196,091 | A | 3/1993 | Hergert | |
| 5,316,383 | A | 5/1994 | Begemann et al. | |
| 5,814,191 | A | 9/1998 | Huovila | |
| 5,833,808 | A | 11/1998 | Shands et al. | |
| 5,958,189 | A * | 9/1999 | Begemann et al. | 162/264 |
| 6,083,351 | A | 7/2000 | Graf et al. | |
| 6,207,018 | B1 | 3/2001 | Munch et al. | |
| 6,227,696 | B1 | 5/2001 | Duchnowski et al. | |

(Continued)

FOREIGN PATENT DOCUMENTS

| | | |
|---|---|---|
| DE | 431840 | 7/1926 |

(Continued)

OTHER PUBLICATIONS

Octopus Stock Approach System An Innovative Solution for Multi-Ply Board and Paper Production, Kadent AES, FCFormtek Products, Queensbury, NY 12804 (Oct. 2005).

*Primary Examiner*—Mark Halpern
(74) *Attorney, Agent, or Firm*—Volpe and Koenig, P.C.

(57) ABSTRACT

A headbox including a stock dilution profiling arrangement and associated stock delivery systems are provided, which together deliver to the forming section of a papermaking machine a uniform stock flow with more consistent basis weight and fiber orientation profiles than has previously been possible. These improvements in basis weight uniformity and fiber orientation profile provide benefits in paper sheet formation and related paper properties.

18 Claims, 10 Drawing Sheets

U.S. PATENT DOCUMENTS

| | | | |
|---|---|---|---|
| 6,821,390 | B2 | 11/2004 | Schadler et al. |
| 6,875,312 | B2 | 4/2005 | Lepomaki et al. |
| 6,902,651 | B2 | 6/2005 | Fujiki et al. |
| 7,067,040 | B2 | 6/2006 | Lepomaki et al. |
| 2002/0195219 | A1 | 12/2002 | Doyle et al. |
| 2005/0016704 | A1 | 1/2005 | Huhtelin |
| 2005/0061465 | A1 | 3/2005 | Schultz |

FOREIGN PATENT DOCUMENTS

| | | |
|---|---|---|
| DE | 3625566 | 1/1987 |
| DE | 3628136 | 3/1988 |
| DE | 4005281 | 8/1991 |
| DE | 4108759 | 9/1992 |
| EP | 0620876 | 10/1996 |
| EP | 0631011 | 3/2000 |
| EP | 1676003 | 7/2006 |
| EP | 1346104 | 11/2006 |
| EP | 1717366 | 11/2006 |
| WO | 2005024127 | 3/2005 |

* cited by examiner

HEADBOX AND STOCK DELIVERY SYSTEM FOR A PAPERMAKING MACHINE

BACKGROUND

The present invention is related to stock delivery systems for papermaking equipment, and in particular to a stock distributor and headbox arrangement to provide uniform consistency stock across a width of a papermaking machine.

Prior known headbox and stock delivery systems for papermaking machines all attempt to varying degrees to distribute the stock flow evenly and uniformly across the width of the papermaking machine. The amount of fiber per unit area (basis weight) is ideally constant across the width of the machine and along the machine direction.

The first step in transforming stock flow from a round pipe, which provides an initial delivery of the stock white water, to a thin rectangular shaped flow from the headbox (the stock jet) is to use a manifold device to distribute or feed the flow evenly into the headbox. Prior to the 1960's, a number of different types of flow spreaders were used, utilizing different piping arrangements. The primary problem with these prior art designs was that the flow was not uniform across the machine as the pipes closest to the incoming connection often received the most flow, starving the others. In the early 1960s, a tapered manifold system was developed for more uniform flow distribution. This system is still widely used today, but there often can be flow distribution issues.

A design where the tapered header is no longer used is also known, with the flow being supplied by a set of separate hoses to the headbox. Flow uniformity is achieved by using a cylindrical tank as the feed source with the hoses connected at a substantially similar height and in a symmetrical radial pattern to ensure uniform inflow conditions. These hoses are of equal length to ensure similar throughput. See U.S. Pat. No. 3,296,066.

To maintain a uniformity of paper in the machine direction, pressure pulsation dampening devices are often used in the stock delivery systems. Many of these incorporate a pressurized air chamber as the dampener and this chamber may be directly in contact with the stock flow (for example, as provided in U.S. Pat. No. 4,146,052) or may utilize a diaphragm interface (for example, as provided in U.S. Pat. No. 4,262,700).

So that a separate pulsation attenuator is not required, cylindrical stock feed tanks with radially distributed outlet hoses have also been combined with air chambers (such as disclosed in DE 431840 C2, EP 0631011 B1). With the advent of dilution profiling for basis weight control (for example, see U.S. Pat. Nos. 4,897,158; 4,909,904; and 5,196,091), this later design was also adapted by adding dilution water addition into the feed hoses (such as disclosed in DE 4005281 C1, U.S. Pat. No. 5,958,189).

The stock is then delivered from the headbox tube bank to the slice lip where it is directed onto the fabric of the papermaking machine, for example as provided in U.S. Pat. Nos. 4,137,124 or 4,783,241.

It would be desirable to provide an apparatus for the delivery of stock to the headbox of a papermaking machine, and from there onto a moving forming fabric, whereby non-uniformities in the resulting web are minimized and the physical properties of the web, especially with respect to basis weight and fiber orientation, are rendered as uniform as possible across the sheet.

SUMMARY

The present invention provides, in combination, a headbox including a stock dilution profiling arrangement and associated stock delivery systems which together deliver to the forming section of a papermaking machine a uniform stock flow with more consistent basis weight and fiber orientation profiles than has previously been possible. These improvements in basis weight uniformity and fiber orientation profile provide benefits in paper sheet formation and related paper properties. The invention comprises a radial stock distributor, a stock dilution assembly, and a headbox which includes a stilling chamber, a tube bank and nozzle with turbulence control vanes, as well as a slice adjustment system to allow for adjustment of the stock slice at the headbox nozzle. A diverging channel can optionally be provided between the stock dilution assembly and the headbox. Edge flow controls to adjust stock flow at the lateral edges can also be provided. The invention has applicability in both single wire fourdrinier papermaking environments, as well as twin wire gap or hybrid type papermaking machines.

In one aspect, the invention includes a stock feed tank of the type generally known in the art, such as disclosed in U.S. Pat. No. 4,146,052. It includes a generally circular cross-sectional shape stock receiving tank. In the preferred embodiment, the stock feed tank further includes a conical diffuser located within the stock receiving tank through which fluid flow from the stock source is directed. The stock receiving tank further includes internal flow separator plates to dampen undesired secondary flows and swirls. A stock distributor block having a radial manifold is preferably also provided in communication with the receiving tank, to evenly distribute flow and increase pressure. A plurality of stock delivery tubes are provided, with each being located in the distributor block and profiled to include a step (internal diameter/cross-sectional area change) to provide a pressure drop and even out stock flow over the face of the block. A perforated plate may also be used as the distributor block. An air pressurized chamber is preferably in communication with the stock receiving tank, opposite the stock distributor block as a pressure fluctuation dampening device. The tank preferably also includes a stock level and air pressurization control. This helps to provide a stable, uniform flow of stock to the headbox.

Connector hoses are attached to the perimeter of the stock feed tank to distribute stock from the tank to a stock dilution system. The connector hoses are each approximately the same length to provide equal pressure and stock flow to the stock dilution system.

A plurality of connector tubes are provided to receive the stock from the connector hoses. Each connector tube has a step expansion followed by a circular cross-section that tapers to a generally rectangular cross-sectional shape. The rectangular-shaped ends are located at regular intervals in the cross-machine direction (CD) across an inlet duct which is attached to the stock dilution assembly.

The stock dilution assembly receives the stock from the inlet duct and includes a source of lower consistency fluid distributed from a tapered header (or similar device) oriented in the CD of the machine and providing fluid to a plurality of dilution feed pipes. The dilution feed pipes convey fluid from the source of lower consistency fluid to individual stock feed pipes in a dilution mixing module. The flow of fluid from each dilution feed pipe is controlled by a valve and an actuator associated with each pipe, which can be adjusted responsive to product quality requirements. Dilution basis weight profiling decouples fiber orientation effects from basis weight control while ensuring an even basis weight profile. Modular construction of the dilution profiling module provides for independent selection of the profiling resolution (i.e. the fineness of the dilution profile) in accordance with grade specification requirements.

The plurality of stock feed pipes receive the stock from the inlet duct and fluid from the dilution feed pipe and deliver the dilution profiled stock to the headbox, preferably through a diverging channel which carries the stock to a stilling chamber in the headbox. The diverging channel, which is preferably a hydraulic elbow, has a flange for attachment to the stock dilution assembly. Alternatively, a straight diverging channel can be utilized in place of the elbow to direct the adjusted stock flow from the dilution assembly to the stilling chamber in the headbox. A perforated plate preferably connects the diverging channel to the stilling chamber. The perforated plate includes a plurality of regularly spaced and uniformly sized openings to allow controlled movement of the now dilution profiled stock from the diverging channel to the stilling chamber.

The headbox preferably includes the stilling chamber, noted above, as well as a tube bank and a nozzle with turbulence vanes to control stock turbulence and minimize streaks. Slice adjustment systems allow for movement of the slice in both the horizontal and vertical directions. The stilling chamber comprises an open area located downstream of the diverging channel and upstream of the tube bank, through which the dilution profiled stock passes towards the tube bank. The stilling chamber allows the pressure to equalize and motions in the fluid stock to dissipate. The tube bank is comprised of a plurality of shaped tubes through which the stock passes as it progresses downstream towards the nozzle and vanes to control turbulence. The tubes are mounted at regular intervals in at least one row and shaped so that their cross-sectional profile transitions from generally circular at their upstream ends to generally square at their downstream ends. The tubes include inserts to create the desired level of pressure drop. Shear is induced in the stock flow as it passes through the tube bank so as to disperse and fluidize the fiber suspension and deliver a controlled scale of motion to the headbox nozzle.

Turbulence vanes are preferably located downstream of the tube bank and are positioned so that stock exiting the tube bank passes either over, or under at least one vane. The geometry of the headbox vanes, including the length, thickness and/or surface characteristics, is selected to provide a desired shear and flow characteristics to meet specific grade and furnish requirements. As requirements change, vanes can be replaced to maintain optimal performance. At the nozzle, turbulence levels and the low contraction design permit low tensile ratio capability with good formation. Vanes in the nozzle maintain flow control for the suspension to be delivered streak-free to the former. High internal stock velocities over polished surfaces of the vanes and the headbox act to provide a high degree of cleanliness.

The slice adjustment system allows movement of the headbox slice in either, or both, the horizontal and vertical directions so as to adjust the speed and direction of stock exiting the headbox slice.

The edge flow control system includes providing for an initial increased flow rate through the edge tubes relative to the interior tubes in the tube bank and valves to control the flow rate of stock through the edge tubes to be either greater or less than that through the interior tubes after valve adjustment. Fiber orientation is separately controlled through slice opening and edge flow rate adjustments.

A robust structural design is preferably provided along with a hot water chamber thermal compensation system at the headbox to ensure maximum stability and cross machine uniformity. Preferably, easy access is provided to all headbox components for inspection and maintenance, including full width internal access, at both the dilution module and inlet face to the tube bank.

BRIEF DESCRIPTION OF THE DRAWINGS

The foregoing summary, as well as the following detailed description of the preferred embodiment of the invention, will be better understood when read in conjunction with the appended drawings. For the purpose of illustrating the invention, the presently preferred embodiment of the invention is shown. It should be understood, however, that the invention is not limited to the precise arrangements shown. In the drawings.

DETAILED DESCRIPTION OF THE PREFERRED EMBODIMENTS

Figure 1:
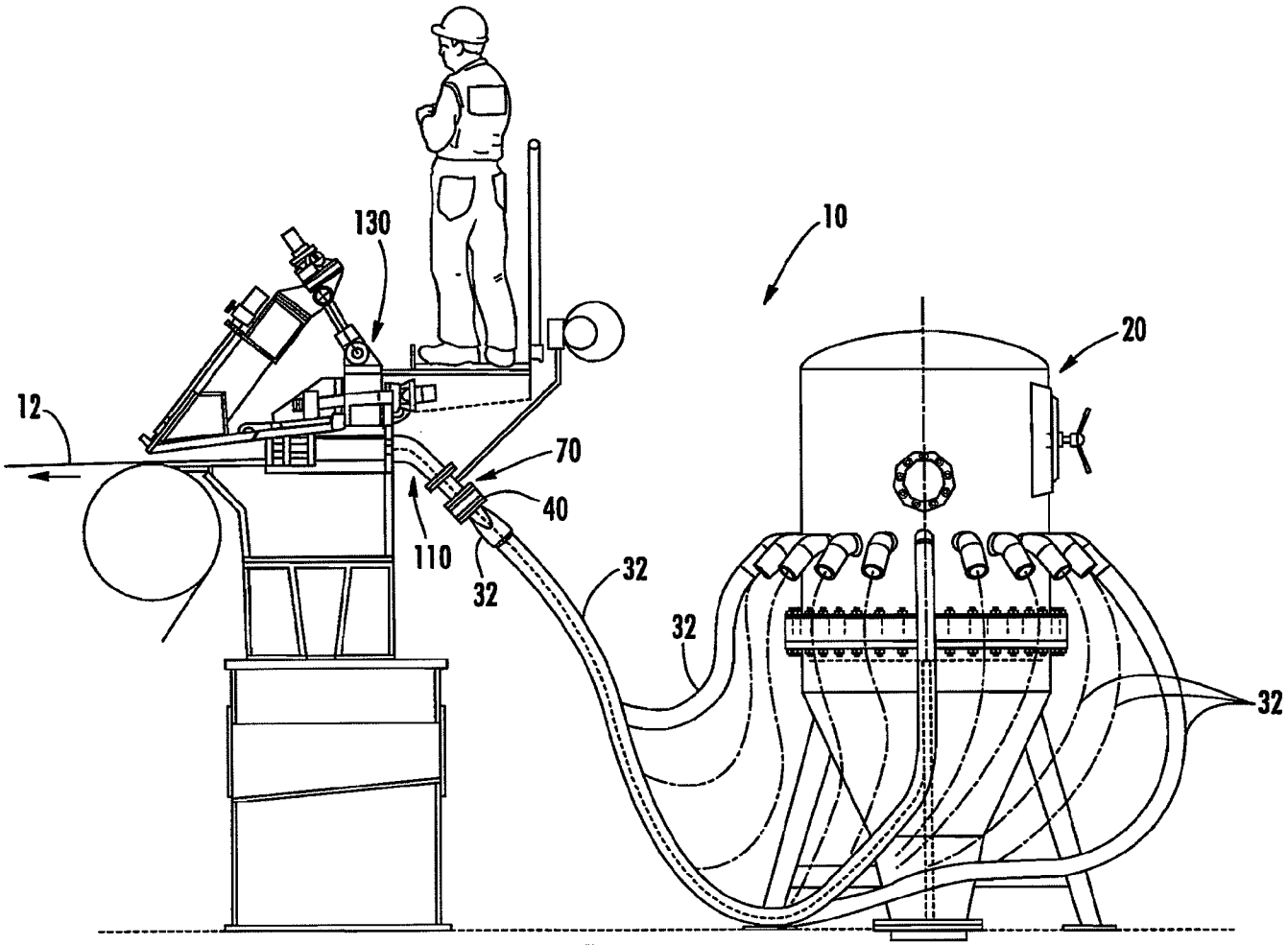
FIG. 1 is an elevational view of a preferred embodiment of a headbox and stock delivery system for a papermaking machine.

Certain terminology is used in the following description for convenience only and is not considered limiting. The words "lower" and "upper" designate directions in the drawings to which reference is made. "CD" refers generally to the cross-direction of the equipment extending across a moving fourdrinier fabric for receiving stock, and "MD" refers to the machine direction or direction of travel of the moving belt in the papermaking machine. The terms "pipes,", "tubes," and "hoses" are used interchangeably herein to refer to a hollow elongated body for conveying fluid, which can be flexible or rigid. Additionally, the terms "a" and "one" are defined as including one or more of the referenced item unless specifically noted.

Referring to FIG. 1, the headbox and stock delivery system 10 for a papermaking machine is shown. The headbox and stock delivery system 10 is comprised of a radial stock distributor 20, a stock dilution assembly 70, a diverging channel 110 and a headbox 130, all of which are described in detail below and which, in combination, provide a uniform and consistent stock flow with a more consistent basis weight and fiber orientation profiles than has previously been possible to a forming fabric 12 of a papermaking machine. While the invention is illustrated in connection with a single wire fourdrinier papermaking machine, it can also be used in connection with two wire gap or hybrid type papermaking machines Still with reference to FIG. 1, the radial stock distributor 20 is preferably of the type generally known in the art, such as disclosed in U.S. Pat. No. 4,146,052, which is incorporated herein by reference as if fully set forth, with several improvements to improve the uniform distribution of stock, including a pulsation dampening system of the type generally known in the art, such as disclosed in U.S. Pat. No. 4,146,052. The radial stock distributor 20 delivers a generally uniform stable flow of stock across the width of the papermaking machine using hoses 32 that lead to the headbox.

The hoses 32 are radially distributed and are preferably centered on a single vertical level. However, depending on flow requirements, more hoses may be required and the centers may be offset vertically in a zig zag or similar fashion in order to provide generally equal pressure while allowing additional hoses to be connected to the upper tank. The hoses 32 are of generally equal length in order to provide equal pressure drops in the stock flow through the hoses 32 to the headbox. This provides for a more uniform flow through the system. In one preferred embodiment, the hoses 32 have an internal diameter between 7.6 and 10 cm (3 and 4 inches).

Figure 2:
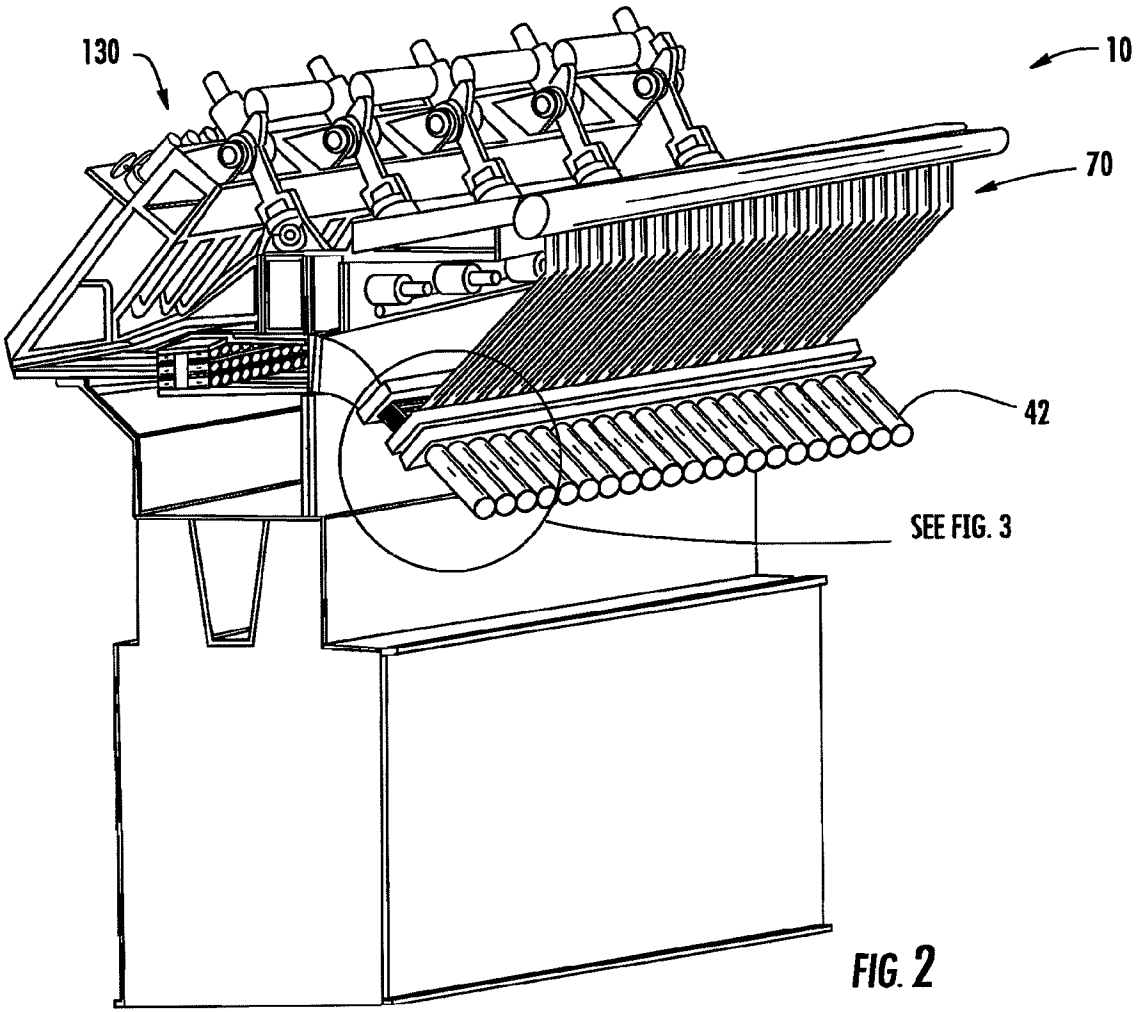
FIG. 2 is a perspective view of the headbox section of the stock delivery system shown in FIG. 1.
Figure 3:
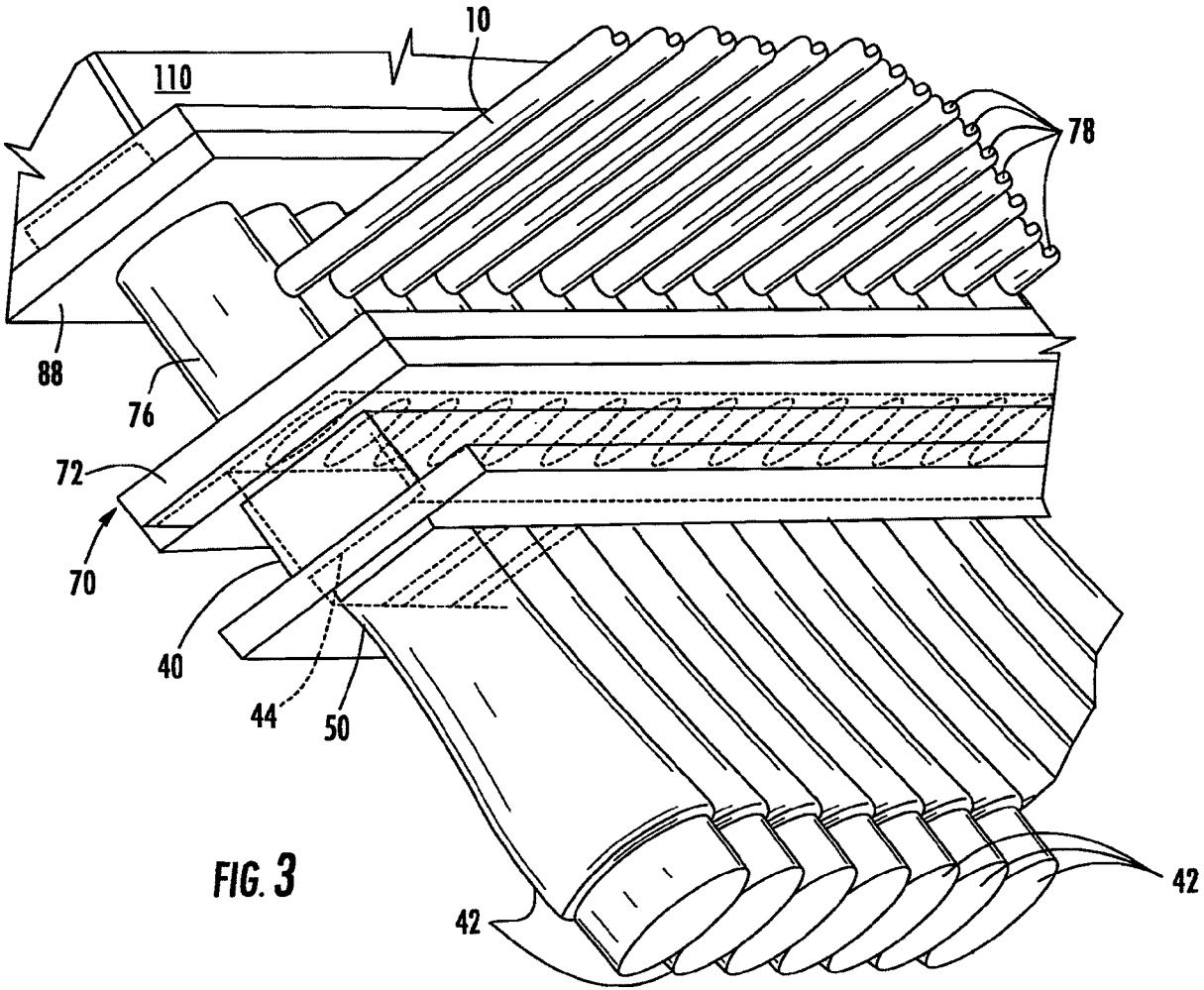
FIG. 3 is an enlarged perspective view of the connector hoses to headbox inlet channel connection as well as a portion of the dilution basis weight profiling system.
Figure 4:
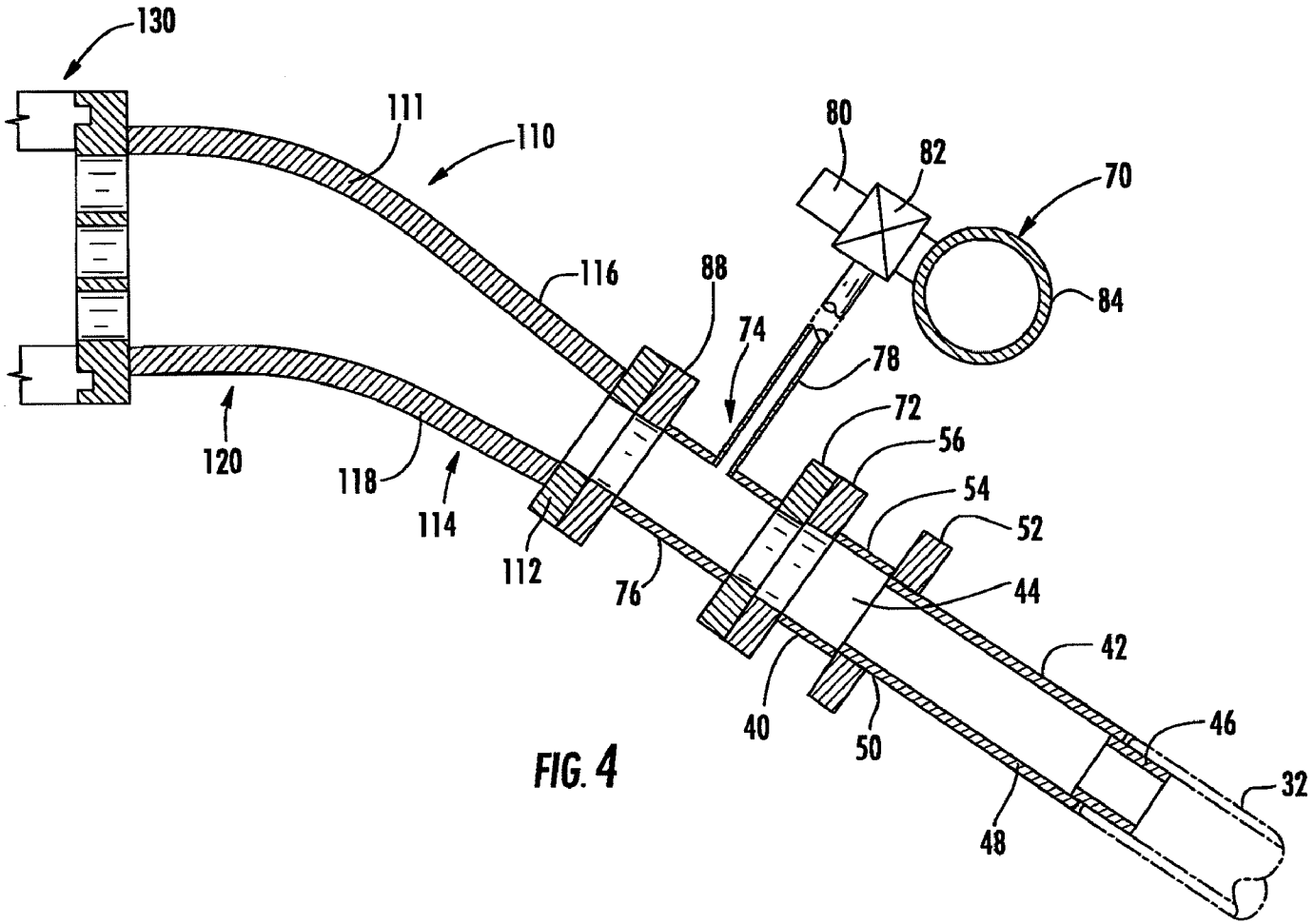
FIG. 4 is a cross-sectional view through a headbox inlet connector showing the dilution basis weight profiling system for a single line as well as the diverging channel for connection to the headbox stilling chamber.

Referring to FIGS. 2-4, the connection from the hoses 32 to the headbox inlet channel 40 is shown in detail in FIGS. 3 and 4, each hose 32 terminates in a hose connector tube 42 which provide a transition from the hoses 32 to a single rectangular opening 44 through the headbox inlet channel 40. As shown in FIG. 4, each hose connector tube 42 is comprised of a smaller diameter tube section 46 and a larger diameter tube section 48. These may be formed in one piece or may include of a smaller tube section 46 which is inserted into the larger tube section 48 at a first end thereof. In our preferred embodiment the O.D. of the smaller tube section 46 is 6.3-10 cm (2.5-4 inches), and the O.D. of the larger tube section 48 is 1.2 cm (0.5 inches) larger at the step transition. The second end 50 of the larger tube section 48 is formed into a generally rectangular shape. In a preferred embodiment, the second end has a width between 1.2 and 2.5 times the height, and more preferably is in a range of 1.4 to 1.8 times the height, with a particularly preferred size being about 1.6 times the height. The second ends 50 of the hose connector tubes 42 are faced into a plate 52 that provides a small, relatively uniform stepped expansion into an open rectangular duct 54, as shown in FIG. 4. The hose connector tubes 42 can be attached by welding or other suitable means. A mounting plate 56 is provided on the downstream end of the duct 54 to provide a sealable connecting surface for mating with the stock dilution assembly 70. The length of duct 54 is sufficiently long to provide coalescence of the separate jets emanating from the hoses and provide a generally uniform flow to the stock dilution assembly. In a preferred embodiment, the length of duct is preferably 10 to 50 times the expansion step height from the connector tube outlet to duct inlet, and more preferably 15 to 25 times the expansion step to allow the flow to reattach and become uniform. In a preferred embodiment, the length is about 20 times the expansion step height from the connector tube outlet to duct inlet. It is important that this length is not too long to minimize stock reflocculation effects and provide maximum fiber and flow uniformity to the stock dilution assembly.

The open rectangular duct 54 provides a generally uniform flow that is evenly distributed by the hoses 32 from the radial stock distributor 20 to the stock dilution assembly. However, in order to improve the basis weight of the stock across the entire CD of the headbox, the stock dilution assembly 70 operates to provide a dilution basis weight profiling system.

Figure 5:
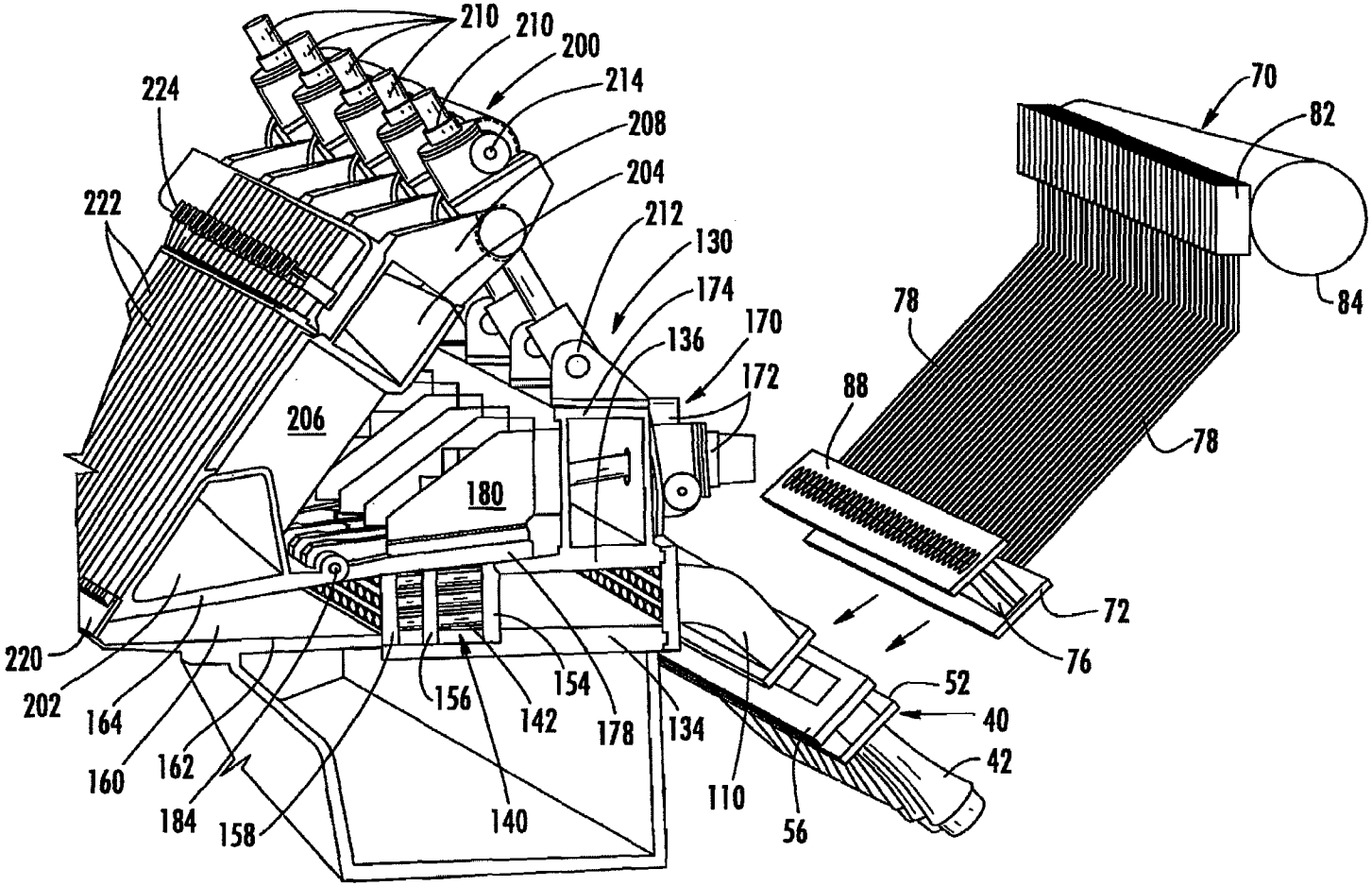
FIG. 5 is a perspective view of a portion of the headbox showing the removable modular nature of the dilution basis weight profiling system, as well as the headbox stilling chamber, tube bank and nozzle along with the location adjustment system for the headbox slice.

Referring now to FIGS. 3-5, the stock dilution assembly 70 is shown in detail. The stock dilution assembly 70 includes an injector module 74, which is defined by a series of pipes 76 which extend across the machine width at a desired profile spacing. The pipes are affixed into inlet plate 72 and outlet plate 88, which mate up to inlet duct 54 and to a diverging channel 110 that conveys the profiled stock to the headbox. In a preferred embodiment, the pipes 76 have a diameter of 5-7.6 cm (2-3 inches) and are spaced at about 7.6-10 cm (3-4 inches) on center. Each pipe 76 has a smaller diameter injection pipe 78 connected thereto at right angles to the main flow direction in order to inject low consistency fluid. The injection velocity of the low consistency fluid from the injection pipe 78 is controlled to be within a range that will permit the entering plume to extend into a middle of the main flow through the stock feed pipe 76 in order to ensure proper mixing with the main flow. The length of the tube is selected to have sufficient distance following the injection port to allow significant jet expansion and mixing with the main flow to occur. The length is kept short for easy access and retrofitting. In a preferred embodiment, the injection pipes 78 have a diameter of 1.2 cm (0.5 inches), and preferably have injection velocities of 1-4 times the velocities in the main injector tubes and tube length past the injector port is 7.6 cm (3 inches). The spacing of the pipes 76 is preferably at the same spacing or twice the spacing of the headbox tube bank tubes, described below. The pipes 76 preferably have a circular cross-sectional area, but may have a rectangular or other cross-sectional shape, depending upon the specific flow profile and the required spacing.

As shown in FIGS. 4 and 5, the injection pipes 78 are each controlled by an actuator 80 connected to a valve assembly 82. This allows for very accurate specific dilution basis weight profiling across the entire CD of the headbox with high adjustability to achieve a generally uniform basis weight profile. Preferably, the valves 82 are fed via a dilution feed water duct 84. This is preferably in the form of a tapered header 84 as shown in FIG. 5 in order to provide a generally more uniform flow profile to each of the valves 82 for the respective injection pipes 78.

An outlet mounting plate 88 is connected to a downstream end of each of the stock feed pipes 76, and is generally parallel to the inlet channel plate 72 such that the entire stock dilution assembly 70 can be slid into or out of the headbox and stock delivery system 10. This also allows retrofitting of the stock dilution assembly 70 into existing equipment or changing out of the stock dilution assembly 70 for a different stock dilution assembly depending upon the particular requirements for a desired application. For example, where a more precise basis weight profile is required, a stock dilution assembly 70 having a greater number of stock feed pipes 76 and injection pipes 78 can be provided for a more precise basis weight profile across the width of the headbox. For example, the pipes 76 could have a more rectilinear shape with about one half the center to center spacing and with about one half of the cross sectional flow area.

Figure 6:
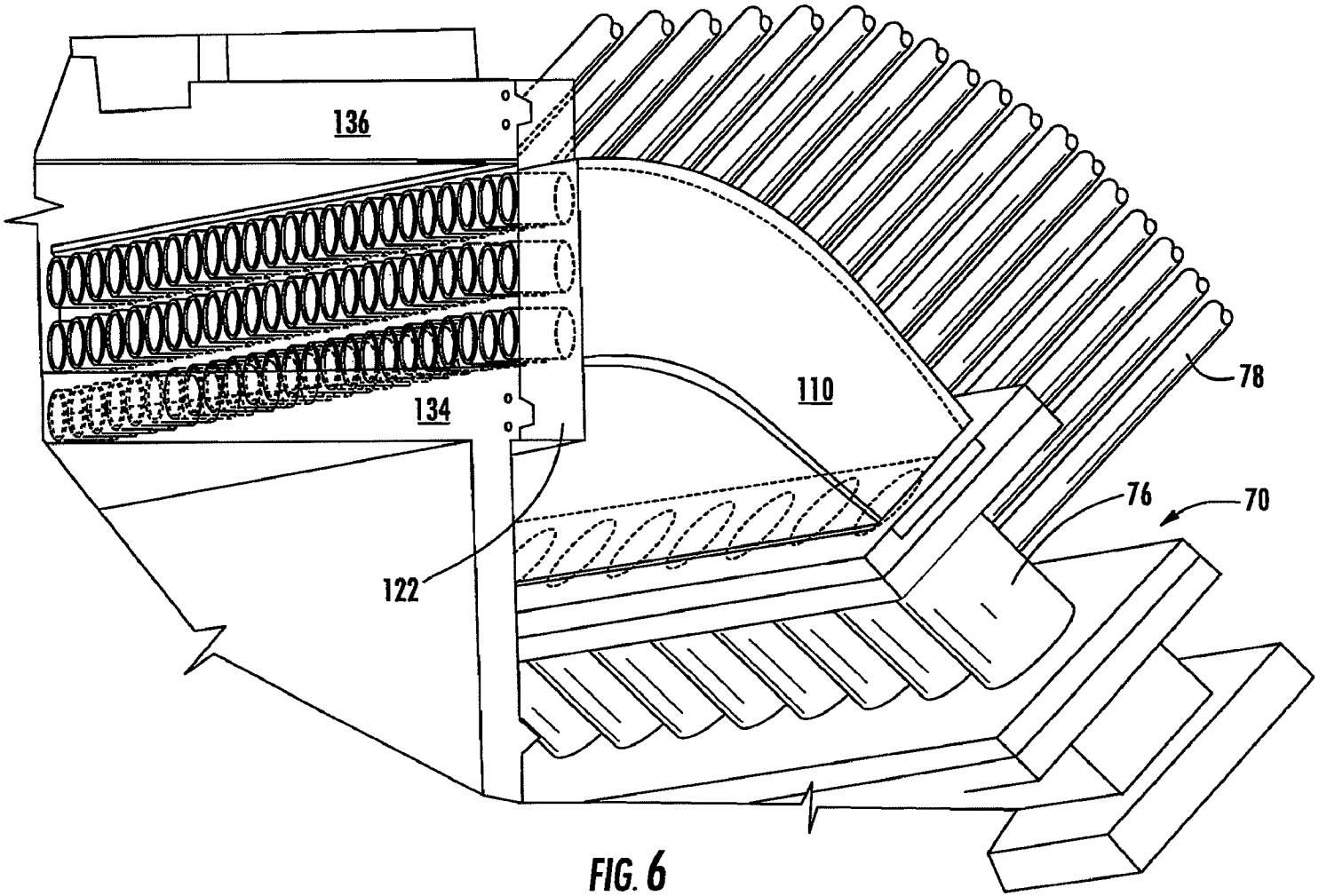
FIG. 6 is a greatly enlarged detail view of the diverging channel and inlet plate to the headbox stilling chamber.

Referring now to FIGS. 4-6, the diverging channel 110 will be explained in further detail. The diverging channel 110 directs flow from the stock dilution assembly to the headbox 130 while maintaining the integrity of the CD consistency profile created by the stock dilution assembly 70. The diverging channel 110 includes a mounting plate 112 for connection to the mounting plate 88 of the stock dilution assembly 70. An initial diverging channel section 114 is formed by walls 116 and 118, with each wall 116, 118 diverging at less than or equal to about 5° to avoid flow separation until the channel depth is equal to or greater than the inlet face of the headbox. Preferably, the diverging channel 110 is in the form of a hydraulic elbow 111, and the initial diverging channel section 114 is followed by a large radius bend section to bend the flow with minimal mixing and without flow separation. In a preferred embodiment, a distance between the walls 116, 118 is about 7.6-10 cm (3-4 inches) at the inlet of the diverging channel 110, and is about 12.7-15.3 cm (5-6 inches) at the outlet. The centerline radius of this bend section is preferably about 2 times the inlet depth or greater, and is sized to reduce or preferably eliminate flow separation of the basis weight consistency profiled stock flow. While the preferred embodiment of the diverging channel 110 is the hydraulic elbow 111, depending on the particular headbox configuration, a straight diverging channel could be utilized.

A perforated plate 122 is connected at the outlet end of the walls 116, 118 for connection to the headbox 130. The perforated plate 122 may include circular holes spaced at the same spacing as the tube bank spacing or may include more rectangular or other shaped holes having a CD center to center spacing that is the same as the CD center-to-center spacing of the tube bank to provide for generally uniform flow while maintaining the basic weight consistency profile across the headbox opening. In the preferred application, the perforated plate 122 is a structural member and supports the inlet opening of the headbox 130. Three rows of 2.5-3.8 cm (1-1.5 inch) diameter holes are provided with a center-to-center spacing of about 3.8-5 cm (1.5-2 inches). The diverging channel 110 is preferably easily removable to allow for easy access to the headbox and/or the stock dilution assembly 70. This provides for better access than was previously available in the known headbox arrangements and allows for easy access to the headbox tube bank as well.

Figure 7:
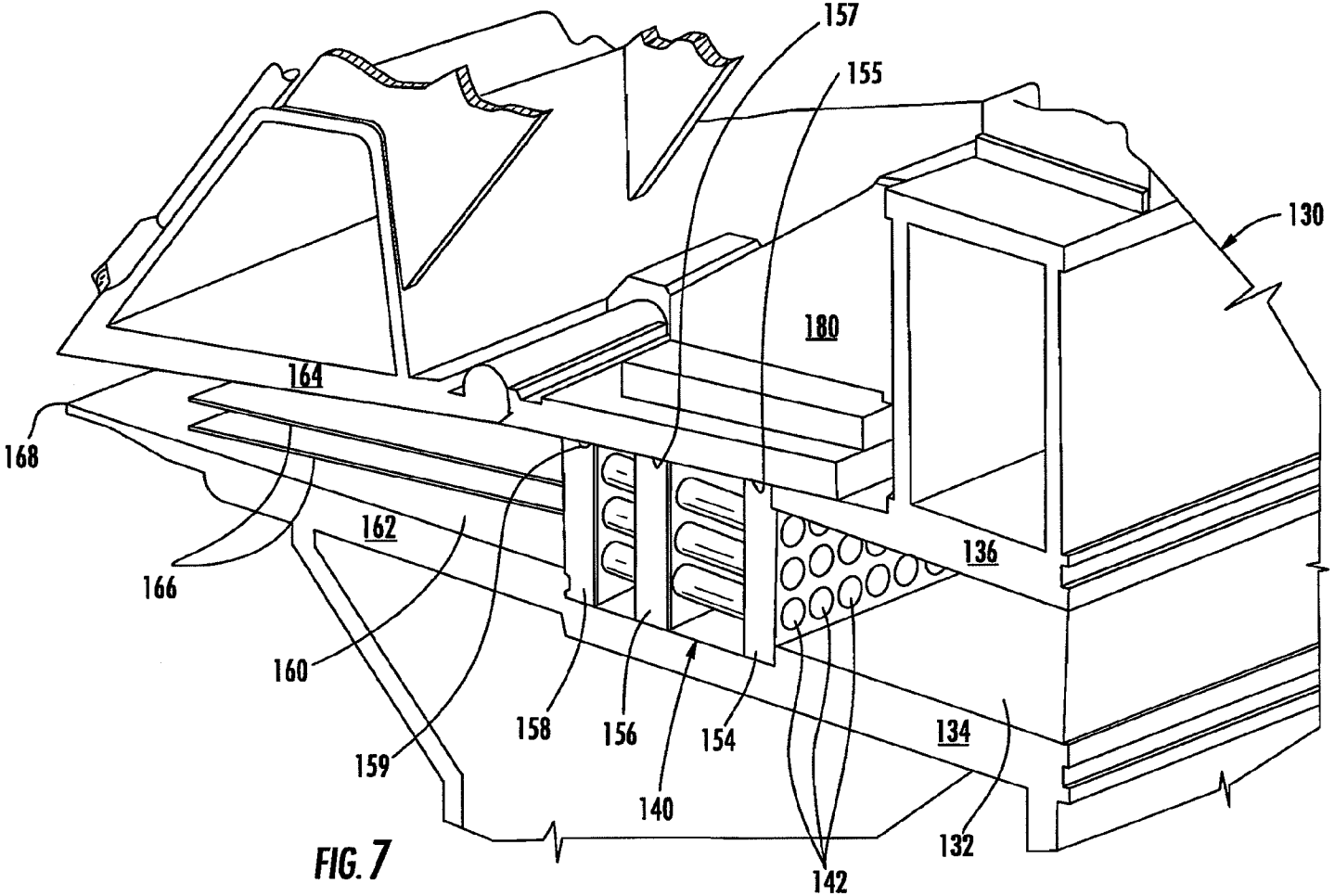
FIG. 7 is an enlarged detailed view showing the headbox tube bank and vanes at the headbox nozzle.

Referring now to FIGS. 5 and 7, the headbox 130 will be described in detail. The headbox 130 includes a stilling chamber 132 located between the perforated plate 122 and the tube bank 140. The stilling chamber 132 provides a uniform flow path for the basis weight profiled stock to the tube bank 140 and is generally bounded by parallel offset upper and lower walls 134 and 136.

Figure 9:
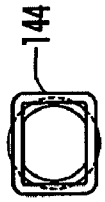
FIG. 9 is an end view taken along line 9-9 in FIG. 8.
Figure 8:
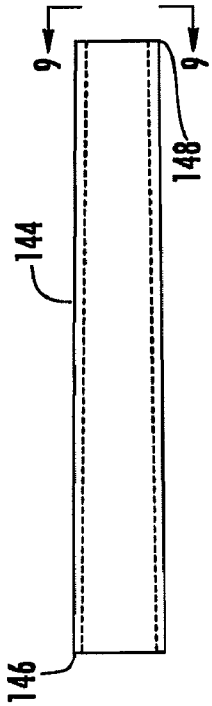
FIG. 8 is an enlarged detail view of a tube from the headbox tube bank according to a first configuration of the invention.
Figure 11:
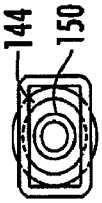
FIG. 11 is a view taken along line 11-11 in FIG. 10.
Figure 10:
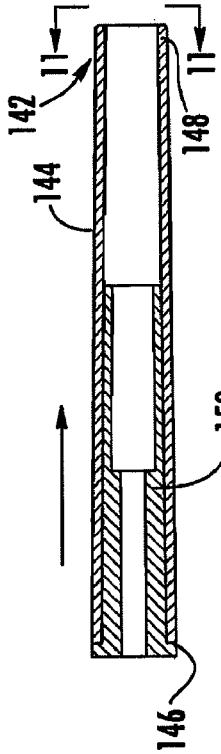
FIG. 10 is a cross-section view of the second embodiment of a tube for the headbox tube bank in accordance with the present invention which includes a stepped insert.
Figure 13:
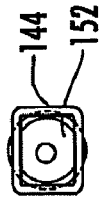
FIG. 13 is a view taken along line 13-13 in FIG. 12.
Figure 12:
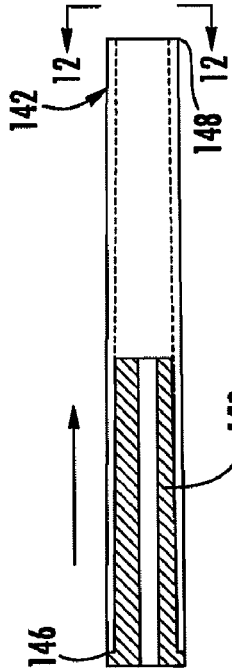
FIG. 12 is a cross-sectional view of a tube from the headbox tube bank in accordance with another embodiment of the invention which includes a straight-walled insert.
Figure 14:
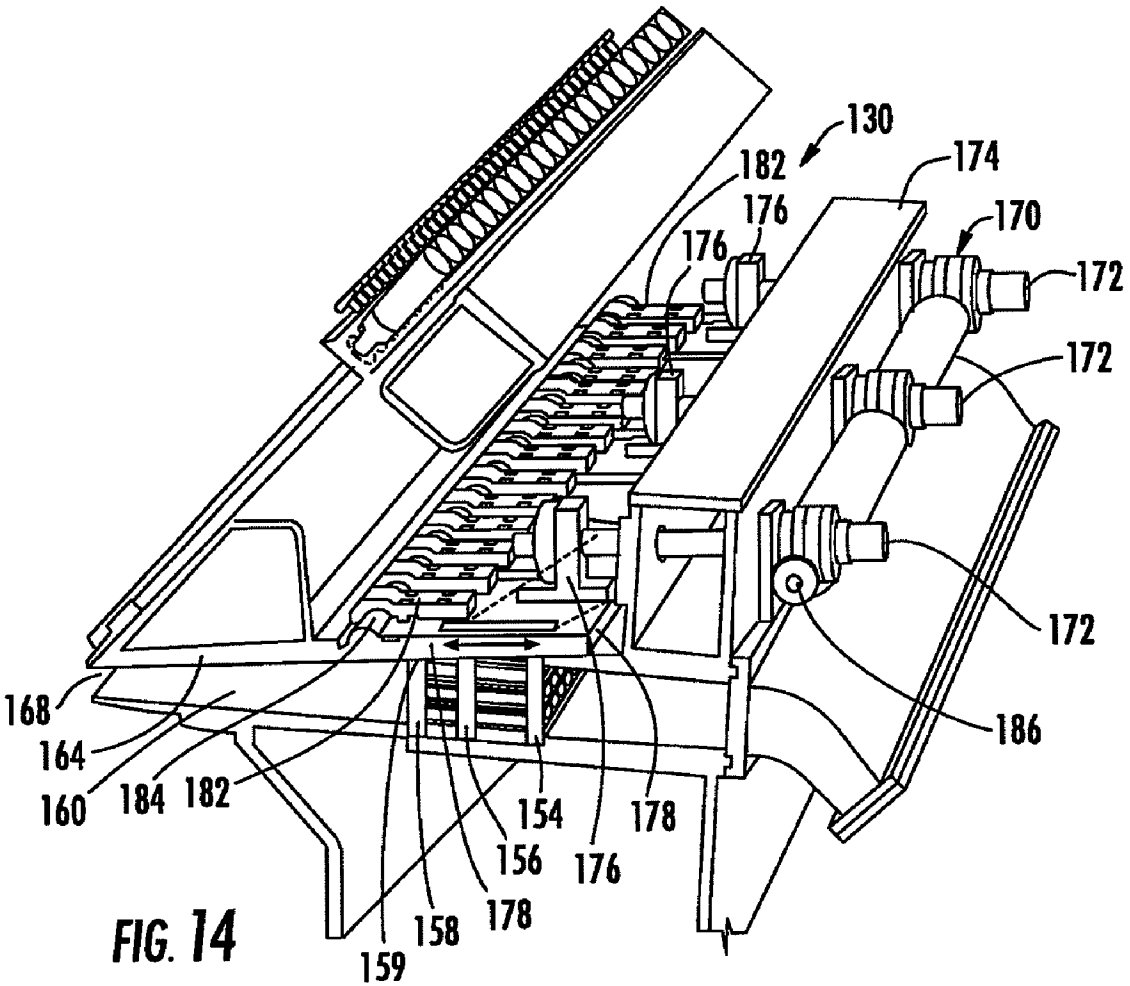
FIG. 14 is a perspective view of the headbox showing the slice adjustment system for horizontally adjusting a position of the slice lip.

The tube bank 140, shown most clearly at FIGS. 5 and 7 includes a plurality of tubes 142 arranged in a plurality of rows three shown, which extend across the entire CD of the headbox. The tubes 142 are supported via supports 154, 156 and 158 and preferably have a generally circular cross-section at the inlet side and a generally square cross-section at the outlet side. The tubes 142 are configured to provide a pressure drop to enhance cross machine flow distribution. The shear and profile expansion provided by the tubes 142 also deflocculates the stock and increase the turbulence level to ensure uniform stock dispersion in the flow. The specific design of the tubes can also affect jet roughness. The tubes 142 are inserted into the supports 154, 156, 158. While a specific arrangement has been shown with three stacked rows of tubes which extend across the CD of the headbox 130, more or less rows could be provided and the tubes could be offset from row-to-row if desired, depending on the particular application. The center-to-center tube spacing is preferably 3.8-5 cm (1.5-2.0 inches) in the preferred embodiment The tubes 142 are preferably comprised of an outer shell 144, as shown in FIGS. 8 and 9. The outer shell 144 preferably has a first, upstream end 146 having a circular cross-section with a diameter of about 2.5-3.8 cm (1.0-1.5 inches) and a downstream end 148 with a generally square cross-section with a height and width of about 2.5-3.8 cm (1.0-1.5 inches). Preferably, an insert 150, 152 is located in the outer shell 144 in order to reduce the cross-sectional area of the tube 142 and drop pressure of the flow by 1.5-7.5 m (5-25 ft) water column. In several preferred embodiments, the insert inlet diameter is about 1.2-2.3 cm (0.5-0.9 inches). Referring to FIGS. 10 and 11, a first insert 150 is shown inserted in the outer shell 144 of the tube 142. The insert 150 is preferably formed of a polymeric material and includes two steps for gradually increasing the cross-sectional flow through area of the tube 142. FIGS. 12 and 13 show an alternate embodiment of the insert 152 which includes a single step in order to increase the cross-sectional flow through area of the tube 142. Various other shaped inserts could be considered depending upon the level of turbulence and pressure drop desired. Following the inserts, the flow reattaches to the cylindrical wall of the main tube before transitioning to the rectangular outlet end with a nearly square opening. Following the inserts, rounded internal corners are maintained and the distance from the insert to the tube exit is kept short to reduce the growth of undesirable secondary flow motions that can lead to streakiness in the final sheet. The I.D. of the corner radiuses at the tube exit may range from 0.5-1.5 cm (0.2 inches to 0.6 inches) and in the preferred embodiment is about 1 cm (0.4 inches). This tube section is comparatively short, generally being 5-25 times the step heights from the expansion as the flow leaves the insert. Both of these factors contribute to better flow with minimized streaking in the paper product being formed. In a preferred embodiment, this tube section length is less than 25.4 cm (10 inches), and more preferably is in the range of 7.6-12.7 cm (3-5 inches).

Still with reference to FIG. 7, the headbox nozzle 160 is shown. This is formed between the lower plate 162 and a pivotable upper plate 164. Preferably, vanes 166 are attached to the downstream support 158. The vanes 166 are preferably connected via dovetail joints into the support 158 and extend generally in the downstream direction. However, other types of detachable connections could be used. The vanes 166 control turbulence for improved jet roughness and also help to minimize streakiness. Preferably, the vanes 166 are located between the rows of tubes 142 in the tube bank 140 and extend toward the headbox slice 168. The vanes are well known in the art of papermaking and preferably made of polycarbonate or graphite composite sheet material.

Referring to FIGS. 5, 7, 14 and 15, a horizontal slice opening adjustment system 170 and a vertical slice opening adjustment system 200 are shown in detail.

The horizontal slice opening adjustment system 170 includes linear actuators 172 spaced across the CD of the headbox 130. These linear actuators 172 are affixed at a first end to fixed structure on the headbox 130 formed by a box beam 174. The second ends of the linear actuators 172 extend to attachment mounts 176 which are connected to a slidable upper plate 178. The upper plate 178 slides on the upper surface of the tube bank supports 154, 156, 158. As shown in FIG. 5, hold down brackets 180 maintain downward pressure on top of the plate 178 while allowing for sliding movement. These hold down brackets 180 have been removed from FIG. 14 for clarity. Elastomeric seals 155, 157, 159 are preferably located on the top of the tube bank supports 154, 156, 158, respectively, to seal against the slidable upper plate 178.

Hinge knuckles 182 are mounted on the upper surface of the plate 178 and engage a hinge pintle 184 formed on the end of the upper wall 164 of the nozzle of the headbox slice. The linear actuators 172 are actuated via a common drive shaft 186 to allow for synchronous, coordinated movement of the sliding plate 178 forward or rearward to adjust the horizontal slice position.

Figure 15:
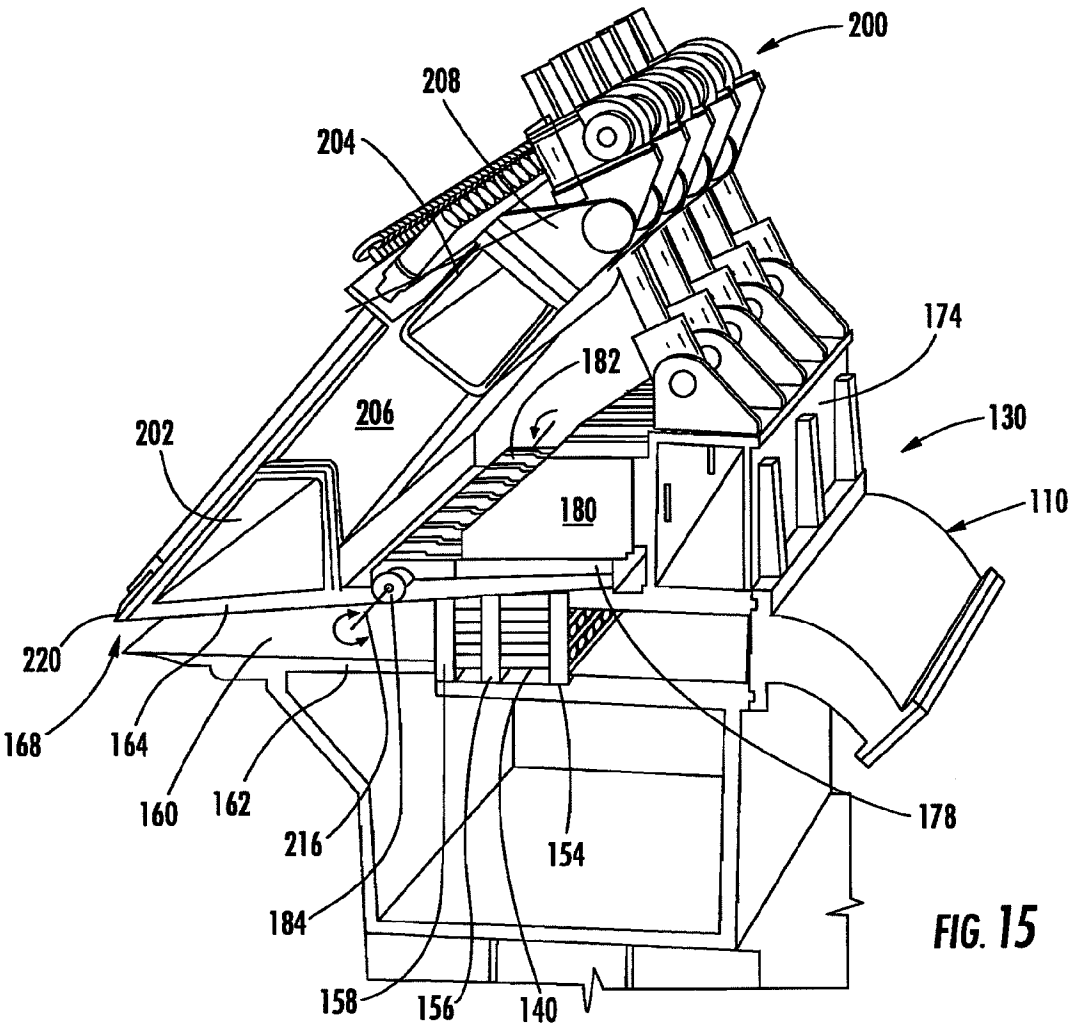
FIG. 15 is a perspective view showing the adjustment system for vertical adjustment of the slice lip.

Referring now to FIGS. 5 and 15, the vertical slice opening adjustment system 200 is shown in detail. In FIG. 15, the horizontal slice opening adjustment system 170 has been omitted for clarity. The vertical slice opening adjustment system 200 rotates the upper wall 164 of the headbox nozzle 160 about the hinge pintle 184 defined at the upstream end of the upper wall 164. The wall 164 comprises part of a tube structure 202 that supports the wall 164 at the headbox nozzle. This is connected to an upper box beam 204 via supports 206. Brackets 208 are connected to the top of the upper box beam 204. Vertical adjustment actuators 210 are connected to the brackets 208 on one side and extend to and are connected to second brackets 212 connected to the box beam 174. The actuators 210 can be commonly actuated via a shaft 214 in order to pivot the upper wall 164 of the nozzle about the axis 216 formed by the hinge pintle 184 and hinge knuckles 182, as shown in FIG. 15. This allows precise adjustment of the slice opening.

An upper lip plate 220 is adjustably positioned along the upper edge of the nozzle 160. Adjustable holding rods 222 and clamps 224, shown most clearly in FIG. 5, adjustably retain the upper lip plate 220 in a desired position. This allows for precise adjustment for the slice lip profile at the exit of the nozzle 160.

Still with reference to FIG. 5, as well known in the art, preferably chambers are provided [not shown] that are filled with heated water at a fixed temperature in order to avoid thermal fluctuations of fluid traveling through the headbox 130. All of the pieces of the headbox are generally modularly constructed in order to permit easy replacement and maintenance. For example, as noted above the stock dilution assembly 70 can be easily removed for maintenance and/or replacement in order to allow finer control of the stock basis weight profile. Additionally, the tubes 142 and the tube bank 140 can be easily accessed and replaced via removal of the diverging channel 110. The actuator for both the horizontal and vertical slice opening adjustment systems 170, 200 are also easily accessible for repair and/or maintenance.

It is generally known that slice lip adjustment on headboxes with dilution control can be used to optimize fiber orientation CD profiles, but sometimes lack the degree of desired control. According to the invention, edge flow can significantly and reliably be adjusted to provide fiber orientation CD control. This is preferably accomplished by providing for increased flow rate through the edge flow tube(s) relative to the interior tubes and using valves for controlling the flow rate through the edge flow tubes to a level either greater or less than the flow rate through the interior tubes. In the preferred embodiment of the invention, edge flow rate can be controlled +/−15% relative to the interior tubes. This allows further adjustments to and control of fiber orientation cross machine profiles. Different diameter inserts are provided in the edge tubes 142 in the headbox than for the interior tubes in order to set the flow through the edge tubes into a desired range. It is also possible to provide a further means for adjustment for the flow rate by either a separate injection of stock flow downstream of the insert or by use of a valve mechanism to adjust available cross sectional flow areas in the edge tubes.

The system 10 according to the invention provides heretofore unattainable adjustability to establish a desired basis weight uniformity and fiber orientation in order to allow optimum paper sheet formation which can be tailored to specific sheet products being formed. While the invention has been disclosed in the context of a single wire fourdrinier papermaking machine, it is understood that this can also be adapted for use in connection with a twin wire gap or hybrid type papermaking machine.

The invention claimed is:

1. A headbox and stock delivery system for a papermaking machine, comprising:

(a) a radial stock distributor including a radial manifold having connector hoses extending therefrom;

(b) a plurality of connector pipes to which the connector hoses from the radial manifold are connected, each of the connector pipes having a step expansion followed by a circular cross-section which tapers to a generally rectangular cross-sectional shape and which are located at regular intervals in a cross-machine direction (CD) across an inlet duct;

(c) a stock dilution assembly which is connected to and receives the stock from the inlet duct, the stock dilution assembly including a plurality of stock feed pipes that extend from the inlet duct, and a respective dilution feed pipe in communication with and adapted to convey fluid from a source of lower consistency fluid to each of the individual stock feed pipes, a flow of fluid from each of the dilution feed pipes being controlled by a respective valve associated with each of the feed pipes, the plurality of stock feed pipes being adapted to receive the stock from the inlet duct and the fluid from the respective ones of the dilution feed pipes to adjust a basis weight consistency of the stock;

(d) a headbox, including a stilling chamber, a tube bank, a nozzle with turbulence vanes to control stock turbulence and minimize streaks, and slice adjustment systems for allowing movement of a headbox slice in both horizontal and vertical directions:

(i) the stilling chamber comprises an open chamber located downstream of and in communication with the stock dilution assembly and upstream of in communication with the tube bank and through which the dilution profiled stock passes towards the tube bank;

(ii) the tube bank comprises of a plurality of shaped tubes through which the stock passes as it progresses downstream towards the nozzle and the vanes to control turbulence, the tubes being mounted at regular intervals in at least one row and shaped so that a cross-sectional profile of the tubes transitions from a generally circular shape at an upstream end to a generally rectilinear shape at a downstream end, and a cross-sectional area of each of the tubes does not diminish in the downstream direction;

(iii) the turbulence vanes are located downstream of the tube bank and are positioned so that stock exiting each of the tubes in the tube bank passes either over or under at least one of the vanes; and (iv) the slice adjustment systems comprise actuators connected to at least one moveable wall that defines the nozzle to adjust a position of the wall so that an opening of the nozzle is adjustable.

2. The headbox and stock delivery system of claim 1, further comprising at least one edge flow control system, including at least one valve to control a flow rate of the stock at cross direction edges of the headbox.

3. The headbox and stock delivery system of claim 1, wherein a length of the inlet duct is 10 to 50 times an expansion step height from an outlet of the connector tubes to an inlet of the duct.

4. The headbox and stock delivery system of claim 3, wherein the length of the inlet duct is 15 to 25 the expansion step height.

5. The headbox and stock delivery system of claim 3, wherein the length of the inlet duct is about 20 times the expansion step height.

6. The headbox and stock delivery system of claim 1, wherein the connector hoses are attached to a perimeter of the radial manifold to distribute stock from the manifold to the stock dilution assembly, the connector hoses each being of approximately the same length to provide equal pressure and stock flow.

7. The headbox and stock delivery system of claim 1, wherein the source of lower consistency fluid comprises a tapered header oriented in the CD.

8. The headbox and stock delivery system of claim 1, wherein a separate actuator is connected to each of the dilution feed pipe valves.

9. The headbox and stock delivery system of claim 1, wherein the dilution feed pipes are connected at approximately right angles to the stock feed pipes.

10. The headbox and stock delivery system of claim 1, further comprising:

a diverging channel connected downstream of the stock dilution assembly and upstream of the headbox, the diverging channel comprises a flange for attachment to the stock dilution assembly, a channel that increases in area in the downstream direction connected to the flange and adapted to direct stock and fluid flow from the dilution assembly to the stilling chamber in the headbox, and a perforated plate located between the channel and the stilling chamber, the perforated plate being provided with a plurality of regularly spaced and uniformly sized openings to allow controlled flow of dilution profiled stock from the dilution assembly through the diverging channel to the stilling chamber.

11. The headbox and stock delivery system of claim 1, wherein the tubes in the tube bank comprise an outer shell with an insert extending from an upstream side into the shell, the insert having a smaller sized flow opening than a downstream exit of the shell.

12. The headbox and stock delivery system of claim 11, wherein the tubes include a tube section downstream of the insert that is generally about 5-25 times an expansion step height from the insert downstream edge to the downstream edge of the tube section.

13. The headbox and stock delivery system of claim 11, wherein the insert has a stepped profile through which the stock is adapted to flow.

14. The headbox and stock delivery system of claim 1, wherein the step expansion of the connector pipes provides at least a 25% percent increase in a cross-sectional flow through area.

15. A method of improving a basis weight consistency profile of stock being delivered to a headbox of a papermaking machine, comprising:

providing stock to the headbox through a plurality of connector hoses that are generally uniformly spaced across a cross-machine direction (CD) of the papermaking machine via an inlet duct that extends across the CD upstream of a stock dilution assembly;

injecting lower consistency stock in a controlled manner into individual stock feed pipes which receive the stock from the connector hoses and are generally uniformly spaced across the CD of the papermaking machine; and individually controlling the flow of lower consistency stock into each of the stock feed pipes using valves to provide a generally uniform basis weight consistency profile for stock entering the headbox.

16. A stock dilution assembly for use in papermaking equipment, comprising:

an inlet adapted to receive stock, a plurality of stock feed pipes that extend from the inlet, a respective dilution feed pipe in communication with and adapted to convey fluid from a source of lower consistency fluid to each of the individual stock feed pipes, a plurality of valves, each being associated with respective ones of the dilution feed pipes so that a flow of fluid from each of the dilution feed pipes is controllable.

17. A headbox and stock delivery system for a papermaking machine, comprising:

(a) a radial stock distributor including a radial manifold having connector hoses extending therefrom;

(b) a plurality of connector pipes to which the connector hoses from the radial manifold are connected, each of the connector pipes having a step expansion followed by a circular cross-section which tapers to a generally rectangular cross-sectional shape and which are located at regular intervals in a cross-machine direction (CD) across an inlet duct;

(c) a headbox, including a stilling chamber, a tube bank, a nozzle with turbulence vanes to control stock turbulence and minimize streaks, and slice adjustment systems for allowing movement of a headbox slice in both horizontal and vertical directions:

(i) the stilling chamber comprises an open chamber located downstream of and in communication with the stock dilution assembly and upstream of in communication with the tube bank and through which the dilution profiled stock passes towards the tube bank;

(ii) the tube bank comprises of a plurality of shaped tubes through which the stock passes as it progresses downstream towards the nozzle and the vanes to control turbulence, the tubes being mounted at regular intervals in at least one row and shaped so that a cross-sectional profile of the tubes transitions from a generally circular shape at an upstream end to a generally rectilinear shape at a downstream end, and a cross-sectional area of each of the tubes does not diminish in the downstream direction;

(iii) the turbulence vanes are located downstream of the tube bank and are positioned so that stock exiting each of the tubes in the tube bank passes either over or under at least one of the vanes; and (iv) the slice adjustment systems comprise actuators connected to at least one moveable wall that defines the nozzle to adjust a position of the wall so that an opening of the nozzle is adjustable.

18. A headbox and stock delivery system for a papermaking machine, comprising:

(a) a stock distributor having connector hoses extending therefrom;

(b) a plurality of connector pipes to which the connector hoses from the stock distributor are connected, each of the connector pipes having a step expansion followed by a circular cross-section which tapers to a generally rectangular cross-sectional shape and which are located at regular intervals in a cross-machine direction (CD) across an inlet duct;

(c) a stock dilution assembly which is connected to and receives the stock from the inlet duct, the stock dilution assembly including a plurality of stock feed pipes that extend from the inlet duct, and a respective dilution feed pipe in communication with and adapted to convey fluid from a source of lower consistency fluid to each of the individual stock feed pipes, a flow of fluid from each of the dilution feed pipes being controlled by a respective valve associated with each of the feed pipes, the plurality of stock feed pipes being adapted to receive the stock from the inlet duct and the fluid from the respective ones of the dilution feed pipes to adjust a basis weight consistency of the stock;

(d) a headbox, including a stilling chamber, a tube bank, a nozzle with turbulence vanes to control stock turbulence and minimize streaks, and slice adjustment systems for allowing movement of a headbox slice in both horizontal and vertical directions:

(i) the stilling chamber comprises an open chamber located downstream of and in communication with the stock dilution assembly and upstream of in communication with the tube bank and through which the dilution profiled stock passes towards the tube bank;

(ii) the tube bank comprises of a plurality of shaped tubes through which the stock passes as it progresses downstream towards the nozzle and the vanes to control turbulence, the tubes being mounted at regular intervals in at least one row and shaped so that a cross-sectional profile of the tubes transitions from a generally circular shape at an upstream end to a generally rectilinear shape at a downstream end, and a cross-sectional area of each of the tubes does not diminish in the downstream direction;

(iii) the turbulence vanes are located downstream of the tube bank and are positioned so that stock exiting each of the tubes in the tube bank passes either over or under at least one of the vanes; and (iv) the slice adjustment systems comprise actuators connected to at least one moveable wall that defines the nozzle to adjust a position of the wall so that an opening of the nozzle is adjustable.

* * * * *